US008685905B2

(12) United States Patent
Kovanda et al.

(10) Patent No.: US 8,685,905 B2
(45) Date of Patent: Apr. 1, 2014

(54) HYDROCARBON-BASED LUBRICANTS WITH POLYETHER

(75) Inventors: Kevin P. Kovanda, Hartland, MI (US); Mark D. Latunski, Morrice, MI (US)

(73) Assignee: American Chemical Technologies, Inc., Fowlerville, MI (US)

( * ) Notice: Subject to any disclaimer, the term of this patent is extended or adjusted under 35 U.S.C. 154(b) by 0 days.

(21) Appl. No.: 13/434,356

(22) Filed: Mar. 29, 2012

(65) Prior Publication Data

US 2013/0261035 A1 Oct. 3, 2013

(51) Int. Cl.
*C10M 145/30* (2006.01)

(52) U.S. Cl.
CPC ..... *C10M 145/30* (2013.01); *C10M 2209/105* (2013.01)
USPC ..... 508/579

(58) Field of Classification Search
CPC ..... C10M 145/30; C10M 2209/105
USPC ..... 508/579
See application file for complete search history.

(56) References Cited

U.S. PATENT DOCUMENTS

| | | | | |
|---|---|---|---|---|
| 3,984,340 | A * | 10/1976 | Sheratte | 252/78.5 |
| 4,793,939 | A | 12/1988 | Mori et al. | |
| 4,990,272 | A * | 2/1991 | Morita et al. | 508/144 |
| 5,576,275 | A | 11/1996 | Moxey | |
| 6,087,307 | A * | 7/2000 | Kaminski et al. | 508/223 |
| 6,127,324 | A | 10/2000 | Tolfa et al. | |
| 6,458,750 | B1 | 10/2002 | Dardin et al. | |
| 2008/0300157 | A1* | 12/2008 | Wu et al. | 508/591 |

FOREIGN PATENT DOCUMENTS

| | | | |
|---|---|---|---|
| CA | 2196852 | A1 | 8/1997 |
| WO | 2006019548 | A1 | 2/2006 |
| WO | WO-2011011656 | A2 | 1/2011 |
| WO | 2013003405 | A1 | 1/2013 |

OTHER PUBLICATIONS

Govind Khemchandani, "Non-Varnishing and Tribological Characteristics of Polyalkylene Glycol-Based Synthetic Turbine Fluid" Lubrication Science vol. 24, No. 1, Aug. 10, 2011 pp. 11-21 Wiley Online Library.

"UCON Fluids and Lubricants," Nov. 1, 2001 DOW publications online.

Martin Greaves et al., "Performance Properties of Oil-Soluble Synthetic Polyalkylene Glycols" Lubrication Science vol. 24, No. 6, Mar. 15, 2012, pp. 251-262 Wiley Online Library.

Martin Greaves, "Oil Soluble Synthetic Polyalkylene Glycols: A New Type of Group V Base Oil" Lube Magazine, vol. 104, Aug. 1, 2011, p. 21-24.

* cited by examiner

*Primary Examiner* — Taiwo Oladapo
(74) *Attorney, Agent, or Firm* — Quinn Law Group, PLLC

(57) ABSTRACT

Disclosed are methods in which an aliphatic polyether selected from polyalkylene oxides with monomer units having 3 to about 10 carbon atoms and polyvinyl ethers with ether groups having 2 to about 8 carbon atoms is added to a hydrocarbon lubricant; such methods in which the hydrocarbon lubricant comprises oxidation products that are dissolved by the addition of the polyether or polyvinyl ether; hydrocarbon lubricants containing a polyether selected from polyalkylene oxides with monomer units having 3 to about 10 carbon atoms and polyvinyl ethers with ether groups having 2 to about 8 carbon atoms; methods of lubricating machines with these lubricants; lubrication systems including these hydrocarbon lubricants; and machines including these lubrication systems.

6 Claims, No Drawings

HYDROCARBON-BASED LUBRICANTS WITH POLYETHER

FIELD OF THE INVENTION

The present invention relates to hydrocarbon-based lubricants and methods.

INTRODUCTION TO THE DISCLOSURE

This section provides information helpful in understanding the invention but that is not necessarily prior art.

Hydrocarbon lubricants are susceptible to oxidation and varnish formation during high temperature uses. The petroleum industry over the years has eliminated some of the impurities from crude oil via hydrocracking or produced synthetic hydrocarbons to minimize oxidation problems later on. In another measure taken to address the problem, nitrogen has been used to blanket the reservoir to prevent a hydrocarbon oil from coming in contact with oxygen. More recently, companies have developed varnish prediction test methods and varnish removal filters to filter out the soluble varnish. In spite of such efforts it still becomes necessary after a period of time in use to remove used oil that has filled with sludge and varnish and recharge the system with new oil. Further, varnish deposits onto machine parts can cause the parts to stick and interfere with operation of a machine.

Both draining and refilling a lubrication system and use of a varnish removal filtration system are expensive options and cannot guarantee that varnish is not deposited onto working machine parts. While there has been progress slowing the oxidation process, predicting the varnish formation, and removing some of the varnish via filtration, varnish can only be removed by filtration if the oil makes its way back to the filter. Oil out in the lines of a lubrication system can continue to degrade and deposit varnish, causing problems with operation of machinery. Dispersants may help keep soft varnish particles suspended in a hydrocarbon lubricant, but the dispersant micelles formed increase lubricant viscosity and affect performance of the lubricant.

SUMMARY OF THE DISCLOSURE

This section provides a general summary rather than a comprehensive disclosure of the full scope of the invention and all its features.

Disclosed are methods in which an aliphatic polyether selected from polyalkylene oxides with monomer units having 3 to about 10 carbon atoms and polyvinyl ethers with ether groups having 2 to about 8 carbon atoms is added to a hydrocarbon lubricant; such methods in which the hydrocarbon lubricant comprises oxidation products that are dissolved by the addition of the polyether or polyvinyl ether; hydrocarbon lubricants containing an aliphatic polyether selected from polyalkylene oxides with monomer units having 3 to about 10 carbon atoms and polyvinyl ethers with ether groups having 2 to about 8 carbon atoms; lubrication systems including these hydrocarbon lubricants; machines including these lubrication systems; and methods of operating machines including these lubrication systems.

In various embodiments of these, the aliphatic polyether is selected from (a) aliphatic polyethers having a formula $$R—O—(R^1O)_nR^2 \quad (I)$$

wherein R and $R^2$ are independently selected from aliphatic hydrocarbyl groups having one to about four carbon atoms and hydrogen, with the caveat that at least one of R and $R^2$ is a hydrocarbyl group, $R^1$ is an aliphatic hydrocarbylene group having from 3 to about 10 carbon atoms, and n is an integer from 4 to about 50 and (b) aliphatic polyvinyl ether homopolymers and copolymers with monomer units having a formula

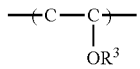

(II)

or a formula

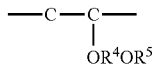

(III)

wherein each $R^3$ is independently selected from aliphatic hydrocarbyl groups having from two to about 8 carbon atoms and each $R^4$ and $R^5$ is independently selected from hydrocarbyl groups having from 1 to about 3 carbon atoms, with the caveat that the number of carbon atoms in $R^4$ and $R^5$ together is from about 2 to about 6. The polyether has a number average molecular weight of from about 300 to about 3000 as determined by gel permeation chromatography using polystyrene standards. The polyether may be added to the hydrocarbon lubricant or included in a hydrocarbon lubricant in an amount from about 2 wt % to about 20 wt % of the polyether, preferably from about 5 wt % to about 20 wt % of the polyether, based on total lubricant weight or in an amount so that the lubricant contains from about 2% to about 7% by weight ether linkages, preferably from about 4 to about 6% by weight ether linkages, based on total lubricant weight.

In various embodiments, a hydrocarbon lubricant containing oxidation products or varnish is treated by adding to the lubricant an aliphatic polyether selected from (a) aliphatic polyethers having a formula $$R—O—(R^1O)_nR^2 \quad (I)$$

wherein R and $R^2$ are independently selected from aliphatic hydrocarbyl groups having one to about four carbon atoms and hydroxyl, hydrogen, with the caveat that at least one of R and $R^2$ is a hydrocarbyl group, $R^1$ is an aliphatic hydrocarbylene group having from 3 to about 10 carbon atoms, and n is an integer from 4 to about 50 and (b) aliphatic polyvinyl ether homopolymers and copolymers with monomer units having a formula

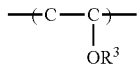

(II)

or a formula

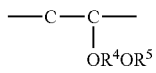

(III)

wherein each $R^3$ is independently selected from aliphatic hydrocarbyl groups having from two to about 8 carbon atoms and each $R^4$ and $R^5$ is independently selected from hydrocarbyl groups having from 1 to about 3 carbon atoms, with the caveat that the number of carbon atoms in $R^4$ and $R^5$ together is from about 2 to about 6. The polyether has a number average molecular weight of from about 300 to about 3000 as determined by gel permeation chromatography using polystyrene standards. The hydrocarbon lubricant containing oxidation products or varnish may be treated with from about 2 wt % to about 20 wt % of the polyether, preferably from about 5 wt % to about 20 wt % of the polyether, based on total treated lubricant weight or may be added in an amount so that the treated lubricant contains from about 2% to about 7% by weight ether linkages, preferably from about 4 to about 6% by weight ether linkages, based on total treated lubricant weight.

In various embodiments, the polyether-containing hydrocarbon lubricants are used in lubrication systems in which the lubricant reaches temperatures above about 100° C. or in which the hydrocarbon lubricant is subject to oxidative conditions.

The lubricants may be used in lubrication systems for turbines, hydraulics, hydrostatic drives, in mobile equipment hydraulics, and in other such machines where cleanliness of the lubricant is an issue.

The disclosed lubricant compositions and methods minimize or prevent varnish formation and extend oil life of hydrocarbon oils used in applications in which they are exposed to high temperatures or oxidative conditions during use. In one method, the lubricant is used to lubricate a power generation turbine. The lubricant dissolves lubricant oxidation products (pre-varnish) and reduces pentane insolubles. This prevents build up of varnish on lubricated surfaces such as turbine system surfaces, which can cause sticky valves and turbine trips of the power generator.

While not wishing to be bound by theory, it is believed that the polyalkylene oxide homopolymers or polyvinyl ethers do not behave as dispersants for the oxidation products and varnish particles but instead increase the polarity of the base hydrocarbon lubricant to allow the lubricant to dissolve the oxidation products and varnish particles. The dissolved oxidation products do not agglomerate.

The disclosed lubricant compositions and methods revitalize used oils (reduced VPR rating) so they do not have to drained and refilled, which saves on waste disposal, eliminates the need to purchase expensive varnish removal filtration systems, and prevents or diminishes future varnish formation to extend oil life.

"A," "an," "the," "at least one," and "one or more" are used interchangeably to indicate that at least one of the item is present; a plurality of such items may be present unless the context clearly indicates otherwise. All numerical values of parameters (e.g., of quantities or conditions) in this specification, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, disclosure of ranges includes disclosure of all values and further divided ranges within the entire range.

Further areas of applicability will become apparent from the description provided herein. It should be understood that the description and specific examples are intended for purposes of illustration only and are not intended to limit the scope of the present disclosure.

DETAILED DESCRIPTION

A detailed description of exemplary, nonlimiting embodiments follows.

A hydrocarbon lubricant base stock is used in these methods and compositions. Hydrocarbon base stocks may be manufactured using a variety of different processes including, but not limited to, distillation, solvent refining, hydrogen processing. oligomerization, esterification, and re-refining. Nonlimiting examples of hydrocarbon base stocks are aliphatic hydrocarbon oils, hydrocracked and severely hydrotreated hydrocarbon oils, furfural-refined paraffinic oil, solvent-refined napthenic oil, and solvent-refined aromatic oil; synthetic hydrocarbon oils, such as poly(alpha-olefin) oils like hydrogenated or partially hydrogenated olefins including hydrogenated hexene oligomers, hydrogenated octene oligomers, hydrogenated decene oligomers, hydrogenated $C_{6-10}$ oligomers, and hydrogenated $C_{8-10}$ oligomers; mineral oils such as liquid petroleum oils and solvent-treated or acid-treated mineral lubricating oils of the paraffinic, naphthenic or mixed paraffinic-naphthenic types such as paraffinic neutral 100", and oils derived from coal or shale; alkylbenzenes such as dodecylbenzenes, tetradecylbenzenes, dinonylbenzenes, di-(2-ethylhexyl)-benzenes; polyphenyls like biphenyls, terphenyls, alkylated polyphenyls; alkylated diphenyl ethers, and mixtures of these.

The polyether-containing hydrocarbon lubricant may be made using a hydrocarbon oil base stock or a fully formulated hydrocarbon lubricant. The polyether-containing hydrocarbon lubricant may be formulated as a new, unused lubricant or may be made from used hydrocarbon lubricant containing oxidation products, such as varnish particles or soft bodies, which may further include one or more lubricant additives.

The hydrocarbon base oil or lubricant is combined with a polyether selected from polyalkylene oxide homopolymers and polyvinyl ether homopolymers and random copolymers. The polyalkylene oxide homopolymers have a formula $$R—O(R^1O)_nR^2 \quad (I)$$

wherein R and $R^2$ are independently selected from hydrocarbyl groups having one to about four carbon atoms and hydrogen, with the caveat that at least one of R and $R^2$ is a hydrocarbyl group, $R^1$ is an aliphatic hydrocarbylene group having from 3 to about 10 carbon atoms, and n is an integer from 4 to about 50. The polyalkylene oxide homopolymer has a number average molecular weight of at least 300. In preferred embodiments the polyalkylene oxide homopolymer has a number average molecular weight of up to about 3000, more preferably up to about 2000, and particular preferably from about 500 to about 1200. The number average molecular weight is determined by gel permeation chromatography using polystyrene standards.

Nonlimiting examples include polypropylene oxide and polybutylene oxide having optionally one hydroxyl endgroup and one alkoxide endgroup or, if there is no hydroxyl end group, two alkoxide endgroups, where the alkoxide endgroups may be methoxide, ethoxide, propoxide, isopropxide, n-butoxide, isobutoxide, sec-butoxide and tert-butoxide endgroups. Such polyalkylene oxide polymers are typically prepared using an alcohol as an initiator molecule by anionic polymerization of an alkylene oxide with base catalysts, e.g. alkali metal hydroxides like potassium hydroxide and sodium hydroxide, sodium methoxide, or metal sodium, or by cationic polymerization of an alkylene oxide with acid catalysts such as aluminum chloride, antimony pentachloride, boron trifluoride, iron(III) chloride, or tin(IV) chloride. Many alkoxide-terminated polyalkylene oxides are commercially available, for example from BASF under the tradename PLURASAFE® and from Dow Chemical under the tradename UCON™

The polyvinyl ether homopolymers and random copolymers have monomer units with a formula

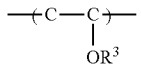

(II)

or a formula

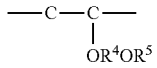

(III)

wherein each $R^3$ is independently selected from aliphatic hydrocarbyl groups having from two to about 8 carbon atoms and each $R^4$ and $R^5$ is independently selected from hydrocarbyl groups having from 1 to about 3 carbon atoms, with the caveat that the number of carbon atoms in $R^4$ and $R^5$ together is from about 2 to about 6. The polyvinyl ether has a number average molecular weight of from about 300 to about 3000 as determined by gel permeation chromatography using polystyrene standards.

Various methods of polymerization of vinyl ethers are discussed in WO 99/64484, which is incorporated herein by reference in its entirety. In one example, vinyl ether monomers may be polymerized at temperatures of −100° C. to 25° C. using a cationic initiator such as boron trifluoride, aluminum chloride, or tin(IV) chloride. Nonlimiting examples of suitable polyvinyl ethers include homopolymers and random copolymers of monovinyl ethers such as vinyl ethyl ether, vinyl propyl ether, vinyl isopropyl ether, vinyl butyl ether, vinyl isobutyl ether, vinyl tertbutyl ether, vinyl 2-methoxyethyl ether, vinyl 2-ethoxyethyl ether, vinyl 2-propoxyethyl ether, and vinyl isoamyl ether.

In various embodiments, the polyether-containing hydrocarbon lubricant that is prepared by combining the hydrocarbon base oil or hydrocarbon lubricant and polyether may contain from about 2 wt % to about 20 wt % of the polyether, preferably from about 5 wt % to about 20 wt % of the polyether, based on total polyether-containing hydrocarbon lubricant weight. In other embodiments, the lubricant contains from about 2% to about 7% by weight ether linkages, preferably from about 4 to about 6% by weight ether linkages, based on total polyether-containing hydrocarbon lubricant weight.

The polyether is not amphiphilic so as to form micelles as would a surfactant. Rather, it is understood that the polyether changes the characteristics of the lubricant to permit oxidation products and varnish particles to dissolve in the lubricant.

The lubricant is preferably free of detergents, surfactants, and dispersants. The lubricant may include one or more additives other than detergents, surfactants, and dispersants. Nonlimiting examples of suitable additives include antioxidants, anti-wear agents, extreme-pressure agents, friction-reducing agents, metal inactivating agents such as benzotriazoles, viscosity modifiers, pour point depressants, stabilizers, corrosion inhibitors, and flammability suppressants. Such additives may be used alone or in any combination of two or more. There are no particular restrictions on the inclusion of such additives. Generally, additives such as these may be present at less than or equal to about 10% by weight of the lubricant composition. Various embodiments of the lubricant composition may include about 0.1 to about 5% by weight of an additive or a combination of additives or about 0.2 to about 2% by weight of an additive or a combination of additives.

Nonlimiting examples of the antioxidants that can be used include phenolic antioxidants such as 2,6-di-t-butyl-4-methylphenol and 4,4'-methylenebis(2,6-di-t-butylphenol), and bisphenol A; amine and thiazine antioxidants such as p,p-dioctylphenylamine, monooctyldiphenylamine, phenothiazine, 3,7-dioctylphenothiazine, N,N-di(2-naphthyl)-p-phenylenediamine, phenyl-1-naphthylamine, phenyl-2-naphthylamine, alkylphenyl-1-naphthylamines, and alkylphenyl-2-naphthylamines; and sulfur-containing antioxidants such as alkyl disulfide, thiodipropionic acid esters and benzothiazole. The lubricant composition may comprise up to about 5.0 weight % antioxidants, about 0.1 to about 5 weight %, about 0.1 to about 2.0 weight %, or about 0.2 to about 0.8 weight % antioxidants. The lubricant compositions may include one or a combination of two or more antioxidant compounds.

In certain embodiments, the lubricant compositions may include one or more extreme pressure or anti-wear additives. Nonlimiting examples of suitable extreme pressure/antiwear additives include sulfur- and phosphorous-containing types such as phosphoric acid esters, acidic phosphoric acid esters, branched alkyl amine phosphates containing 5 to 20 carbon atoms, thiophosphoric acid esters, acidic phosphoric acid ester amine salts, and chlorinated phosphoric acid esters and phosphorous acid esters that are esters of phosphoric acid or phosphorous acid with alkanols or polyether alcohols. Specific, nonlimiting examples of phosphoric acid esters include tributyl phosphate, tripentyl phosphate, trihexyl phosphate, triheptyl phosphate, trioctyl phosphate, trinonyl phosphate, tridecyl phosphate, triundecyl phosphate, tridodecyl phosphate, tritridecyl phosphate, tritetradecyl phosphate, tripentadecyl phosphate, trihexadecyl phosphate, triheptadecyl phosphate, trioctadecyl phosphate, trioleyl phosphate, triphenyl phosphate, tricresyl phosphate, trixylenyl phosphate, cresyldiphenyl phosphate, and xylenyldiphenyl phosphate. Specific, nonlimiting examples of acidic phosphoric acid esters there may be mentioned monobutyl acid phosphate, monopentyl acid phosphate, monohexyl acid phosphate, monoheptyl acid phosphate, monooctyl acid phosphate, monononyl acid phosphate, monodecyl acid phosphate, monoundecyl acid phosphate, monododecyl acid phosphate, monotridecyl acid phosphate, monotetradecyl acid phosphate, monopentadecyl acid phosphate, monohexadecyl acid phosphate, monoheptadecyl acid phosphate, monooctadecyl acid phosphate, monooleyl acid phosphate, dibutyl acid phosphate, dipentyl acid phosphate, dihexyl acid phosphate, diheptyl acid phosphate, dioctyl acid phosphate, dinonyl acid phosphate, didecyl acid phosphate, diundecyl acid phosphate, didodecyl acid phosphate, ditridecyl acid phosphate, ditetradecyl acid phosphate, dipentadecyl acid phosphate, dihexadecyl acid phosphate, diheptadecyl acid phosphate, dioctadecyl acid phosphate and dioleyl acid phosphate. Specific, nonlimiting examples of thiophosphoric acid esters include tributyl phosphorothionate, tripentyl phosphorothionate, trihexyl phosphorothionate, triheptyl phosphorothionate, trioctyl phosphorothionate, trinonyl phosphorothionate, tridecyl phosphorothionate, triundecyl phosphorothionate, tridodecyl phosphorothionate, tritridecyl phosphorothionate, tritetradecyl phosphorothionate, tripentadecyl phosphorothionate, trihexadecyl phosphorothionate, triheptadecyl phosphorothionate, trioctadecyl phosphorothionate, trioleyl phosphorothionate, triphenyl phosphorothionate, tricresyl phosphorothionate, trixylenyl phosphorothionate, cresyldiphenyl phosphorothionate, and xylenyldiphenyl phosphorothionate. Specific, nonlimiting examples of amine salts of acidic phosphoric acid esters include salts of acidic phosphoric acid esters with amines such as methylamine, ethylamine, propylamine, butylamine, pentylamine, hexylamine, heptylamine, octylamine, dimethylamine, diethylamine, dipropylamine, dibutylamine, dipentylamine, dihexylamine, diheptylamine, dioctylamine, trimethylamine, triethylamine, tripropylamine, tributylamine, tripentylamine, trihexylamine, triheptylamine, and trioctylamine. Specific, nonlimiting examples of chlorinated phosphoric acid esters include tris(dichloropropyl)phosphate, tris(chloroethyl)phosphate, tris(chlorophenyl)phosphate, and polyoxyalkylene bis[di(chloroalkyl)]phosphate. As phosphorous acid esters there may be mentioned dibutyl phosphite, dipentyl phosphite, dihexyl phosphite, diheptyl phosphite, dioctyl phosphite, dinonyl phosphite, didecyl phosphite, diundecyl phosphite, didodecyl phosphite, dioleyl phosphite, diphenyl phosphite, dicresyl phosphite, tributyl phosphite, tripentyl phosphite, trihexyl phosphite, triheptyl phosphite, trioctyl phosphite, trinonyl phosphite, tridecyl phosphite, triundecyl phosphite, tridodecyl phosphite, trioleyl phosphite, triphenyl phosphite, and tricresyl phosphite. The extreme pressure/antiwear additives may be used individually or in any combination, in any desired amount. In various embodiments, the lubricant composition may include about 0.01 weight % to about 5.0 weight %, about 0.01 weight % to about 4.0 weight %, about 0.02 weight % to about 3.0 weight %, or 0.1 weight % to about 5.0 weight % each of extreme pressure additives and antiwear additives. These additives may be used alone or in any combination.

In various embodiments, the lubricant composition may include one or more corrosion inhibitors, such as those selected from isomeric mixtures of N,N-bis(2-ethylhexyl)-4-methyl-1H-benzotriazole-1-methylamine and N,N-bis(2-ethylhexyl)-5-methyl-1H-benzotriazole-1-methylamine. The lubricating composition may include about 0.01 to about 1.0 weight % of one or more corrosion inhibitors, about 0.01 to about 0.5 weight % of one or more corrosion inhibitors, or about 0.05 to about 0.15 weight % of one or more corrosion inhibitors.

Viscosity modifiers (or viscosity index improvers) are polymeric materials, typical examples of these being polyolefins, such as ethylene-propylene copolymers, hydrogenated styrene-isoprene block copolymers, hydrogenated copolymers of styrene-butadiene, copolymers of ethylene and propylene, acrylic polymers produced by polymerization of acrylate and methacrylate esters, hydrogenated isoprene polymers, polyalkyl styrenes, hydrogenated alkenyl arene conjugated diene copolymers, polyolefins, esters of maleic anhydride-styrene copolymers, and polyisobutylene.

Nonlimiting examples of pour point depressants include polyalkyl methacrylates, polyalkyl acrylates, polyvinyl acetate, polyalkylstylenes, polybutene, condensates of chlorinated paraffin and naphthalene, and condensates of chlorinated paraffin and phenol Nonlimiting examples of flammability suppresants include trifluorochloromethane, trifluoroiodomthane, phosphate esters and other phosphorous compounds, and iodine- or bromine-containing hydrocarbons, hydrofloroarbons, or fluorocarbons.

A hydrocarbon lubricant may be treated by adding to the lubricant a polyether selected from polyalkylene oxide homopolymers with monomer units having 3 to about 10 carbon atoms and polyvinyl ethers with ether groups having 2 to about 8 carbon atoms as described. The hydrocarbon lubricant that is treated may contain an oxidation product, e.g. varnish or pre-varnish oxidation products, and the polyether may be added in an amount sufficient to cause the oxidation products to dissolve in the lubricant. In various embodiments, the polyether is added in an amount such that the lubricant comprises at least one of: (a) from about 2 wt % to about 20 wt % of the polyether and from about 2% to about 7% by weight ether linkages from the polyether. In various embodiments the viscosity of a hydrocarbon lubricant containing varnish, pre-varnish, or other oxidation products is reduced by the addition of the polyether to a greater degree that would be expected based on a weighted average of the viscosity of the hydrocarbon lubricant and the viscosity of the polyether.

A lubricant treatment composition for treating hydrocarbon lubricant containing varnish or other oxidation products includes the polyether as described and at least one additive other than detergents, surfactants, and dispersants. In various embodiments, the additive is selected from antioxidants, antiwear agents, extreme-pressure agents, friction-reducing agents, metal inactivating agents such as benzotriazoles, viscosity modifiers, pour point depressants, stabilizers, corrosion inhibitors, flammability suppressants, and combinations of these. In particular embodiments, the lubricant treatment composition comprises the polyether and an antioxidant. The lubricant treatment composition reduces the viscosity of a hydrocarbon lubricant containing varnish, pre-varnish, or other oxidation products to a greater degree that would be expected based on a weighted average of the viscosity of the hydrocarbon lubricant and the viscosity of the lubricant treatment composition.

The oxidation products dissolve and do not agglomerate in the hydrocarbon lubricant containing the polyether. This is demonstrated in the following examples in which testing for Varnish Potential shows condemned 'used' oil returning to good working condition. Viscosity of used hydrocarbon oil decreases, ISO cleanliness codes decrease, pentane insolubles decrease, lubrication properties increase, and VPR (varnish potential rating) is reduced to 'as new fluid' acceptable for use.

EXAMPLES

Example 1

Remediation of Used Turbine Oil

A sample of used Chevron GST-32 turbine oil was removed from a system that had been experiencing system trips and varnish problems. The parameters of the used oil were measured according to the following published test methods.

VP Pentane Insolubles—ASTM D 893
Ultra-Centrifuge Sediment Rating—Mobil Method 1169
Filter Patch Colorimetry—ASTM W K 27308
Ruler %—ASTM D 6971
Varnish Potential Rating—ASTM D 4378
Viscosity (SUS)—ASTM D 445
Total Acid Number—ASTM D 664
Water Content—ASTM E 203
Particle Count—ISO 4406.

The measured values of the used Chevron GST-32 turbine oil as removed from the system are shown in Table 1. The parameters of a new, unused sample of Chevron GST-32 turbine oil were also measured and are shown in Table 1.

A portion of 90 parts by weight of the used Chevron GST-32 turbine oil was combined with 10 parts by weight of polypropylene oxide, terminated with one butyl ether group and one hydroxyl group, having a number average molecular weight of 1000, and containing 0.6 wt % of the butylated reaction product of p-cresol and dicyclopentadiene (CAS #68610-51-5) and 0.01 wt % Cobratec 122 (available form PMC Specialties Group Inc., Cincinnati, Ohio) to make a remediated turbine oil. The parameters of this remediated Chevron GST-32 turbine oil were measured and are shown in Table 1.

Theoretical values of the parameters were determined for a combination of 90 parts by weight of the used Chevron GST-32 turbine oil combined with 10 parts by weight of the polypropylene oxide by taking a weighted average of the values of the individual fluids. The theoretical values represent oil property values that would be expected if the polyether had no effect on the varnish particles contained in the used Chevron GST-32 turbine oil. These values are also shown in Table 1. The difference between the theoretical parameter values and the values actually obtained by combining the used turbine oil with the polypropylene oxide demonstrate that the added polypropylene oxide eliminated the soft varnish particles from the used turbine oil. The used Chevron GST-32 turbine oil remediated with 10 wt % polypropylene oxide had a 75% elimination of pentane insolubles, an ultra-centrifuge sediment rating equivalent to the new oil, and a reduction in measured color bodies. Results of the Ruler test show a 10% boost over the expected value in the antioxidant content of the original Chevron GST-32 antioxidant, which differs from the antioxidant that was combined with the polypropylene added to remediate the used oil. A 10-unit SUS drop in viscosity for the remediated oil is also evidence that the soft varnish particles have been dissolved into the oil. The polypropylene oxide also releases other polar molecules, such as water, as the varnish breaks up.

| | New Chevron GST-32 turbine oil | Used Chevron GST-32 turbine oil | Actual 90 wt % Chevron GST-32 turbine oil to 10 wt % Polypropylene oxide | Theoretical 90 wt % used Chevron GST-32 turbine oil to 10 wt % Polypropylene oxide |
|---|---|---|---|---|
| VP Pentane Insolubles (mg/L) | 74 | 92 | 21 | 83 |
| Ultra-Centrifuge Sediment Rating | 1 | 3 | 1 | 2.7 |
| Filter Patch Colorimetry | 1 | 32 | 12 | 28 |
| Ruler % | 100 | 74 | 72 | 67 |
| Varnish Potential Rating | Low | Elevated | Low | Elevated |
| Viscosity (SUS), cSt | 161 | 176 | 163 | 172 |
| Total Acid Number (mg KOH/g) | 0.07 | 0.44 | 0.10 | 0.42 |
| Water (ppm) | 137 | 137 | 384 | 183.4 |
| Particle Count | 17/14/11 | 20/16/12 | 19/17/13 | 20/16/12 |

Example 2

Remediation of Used Turbine Oil

A sample of used Mobil SHC-824 turbine oil was removed from a system that had excessive varnish. The parameters of the used oil were measured and are given in Table 2. A portion of 90 parts by weight of the used Mobil SHC-824 turbine oil was combined with 10 parts by weight of polypropylene oxide, terminated with one butyl ether group and one hydroxyl group, having a number average molecular weight of 1000, and containing 0.6 wt % of the butylated reaction product of p-cresol and dicyclopentadiene (CAS #68610-51-5) and 0.01 wt % Cobratec 122 (available form PMC Specialties Group Inc., Cincinnati, Ohio) to make a remediated turbine oil. The parameters of this remediated Mobil SHC-824 turbine oil were measured and are shown in Table 2. Finally, theoretical values of replenishing the lubrication system with new Mobil SHC-824 turbine oil are shown in Table 2.

| | Used Mobil SHC-824 turbine oil | Actual 90 wt % Mobil SHC-824 turbine oil to 10 wt % Polypropylene oxide | Replenishing with new Mobil SHC-824 turbine oil |
|---|---|---|---|
| Viscosity (SUS), cSt | 161 | 148 | 158 |
| Total Acid Number (mg KOH/g) | 0.98 | 0.29 | 0.91 |
| Water (ppm) | 81 | 211 | 133 |
| Particle Count | 24/21/21 | 23/18/18 | 24/21/21 |

The addition of the polypropylene oxide reduced the viscosity of the turbine oil by 3 cSt (10 SUS) below a theoretical value. This demonstrates that the addition of the polypropylene oxide significantly reduced the effective molecular weight of the lubricant by reducing the agglomeration of polar bodies that had formed soft varnish particles in the used oil. A reduction in total acid number demonstrates a re-established balance between aminic and phenolic antioxidants active in the used turbine fluid. The reduction in particle count for the remediated used oil shows that the added polypropylene oxide removed varnish particles from the used turbine oil by dissolving them.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A lubricant composition comprising a hydrocarbon oil and from about 2 wt % to about 20 wt % of a polyalkylene oxide homopolymer that has a formula $$R—O\text{-}(R^1O)\text{-}_nR^2 \quad (I)$$

wherein R and $R^2$ are independently selected from hydrocarbyl groups having one to about four carbon atoms and hydrogen, with the caveat that at least one of R and $R^2$ is a hydrocarbyl group, $R^1$ is an aliphatic hydrocarbylene group having 3 carbon atoms, and n is an integer from 4 to about 50, wherein the lubricant composition is an oil, wherein the polyalkylene oxide homopolymer comprises a butoxide-terminated polypropylene oxide.

2. A lubricant composition according to claim 1, wherein the lubricant comprises at least one of:

(a) from about 5 wt % to about 20 wt % of the polyalkylene oxide homopolymer and (b) from about 4% to about 6% by weight ether linkages from the polyalkylene oxide homopolymer.

3. A lubrication system comprising a lubricant composition according to claim 1.

4. A machine comprising the lubrication system of claim 3.

5. A machine according to claim 4, wherein the machine comprises a turbine, hydraulic, hydrostatic drive, or mobile equipment hydraulic machinery.

6. A method of operating a machine comprising lubricating the machine with a lubricant composition according to claim 1.

* * * * *